United States Patent [19]

Propst

[11] 4,279,204

[45] Jul. 21, 1981

[54] LIGHTWEIGHT STACKABLE PALLET

[75] Inventor: Robert L. Propst, Bellvue, Wash.

[73] Assignee: Herman Miller, Inc., Zeeland, Mich.

[21] Appl. No.: 80,303

[22] Filed: Oct. 1, 1979

[51] Int. Cl.[3] ..... B65D 19/26

[52] U.S. Cl. ..... 108/53.3; 108/51.1; 108/53.1

[58] Field of Search ..... 108/53.3, 56.3, 56.1, 108/51.1, 51.3, 53.1, 55.1–55.5, 57.1; 206/386, 599, 600

[56] References Cited

U.S. PATENT DOCUMENTS

| | | | |
|---|---|---|---|
| 2,544,657 | 3/1951 | Cushman | 108/53.3 |
| 3,267,883 | 8/1966 | Vissers | 108/53.3 |
| 3,294,040 | 12/1966 | Gregoire | 108/57.1 X |
| 3,509,832 | 5/1970 | Daisley, Jr. | 108/51.1 |
| 3,531,855 | 10/1970 | Spring, Jr. | 108/51.1 X |
| 3,610,172 | 10/1971 | Wharton | 108/53.3 |
| 3,868,915 | 3/1975 | Hafner | 108/53.1 X |

FOREIGN PATENT DOCUMENTS

| | | | |
|---|---|---|---|
| 2411136 | 8/1979 | France | 108/56.3 |
| 337125 | 4/1959 | Switzerland | 108/53.3 |
| 781698 | 8/1957 | United Kingdom | 108/51.1 |

*Primary Examiner*—William E. Lyddane

*Attorney, Agent, or Firm*—Olsen and Stephenson

[57] ABSTRACT

A pallet having a generally rectangular body consisting of a honeycomb core enclosed within top, bottom, and side walls. Each of the side walls has at its upper end an upwardly and inwardly inclined portion and at its lower end a downwardly and inwardly inclined portion. Hollow tapered legs are provided at the corners of the pallet facilitate stacking of the pallets in a minimum space.

1 Claim, 5 Drawing Figures

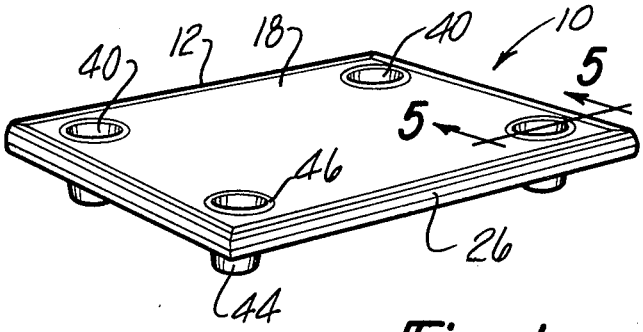
Fig-1
Fig-2
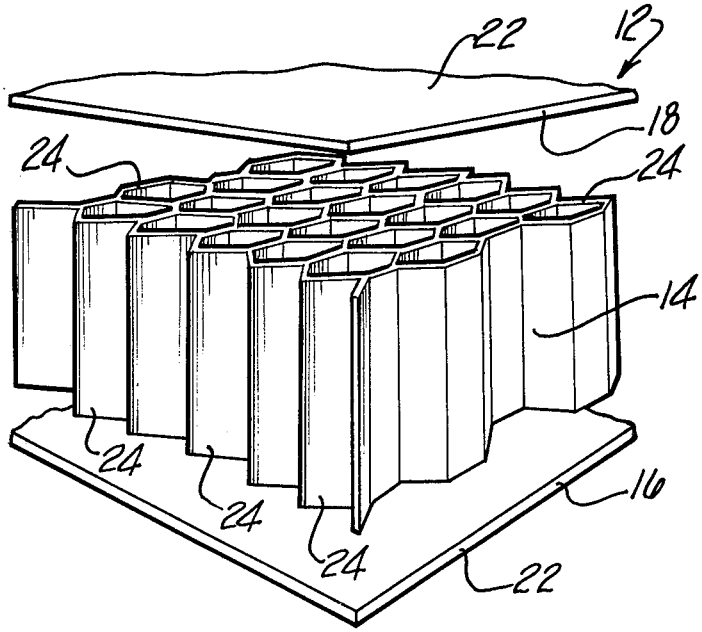

Fig-3
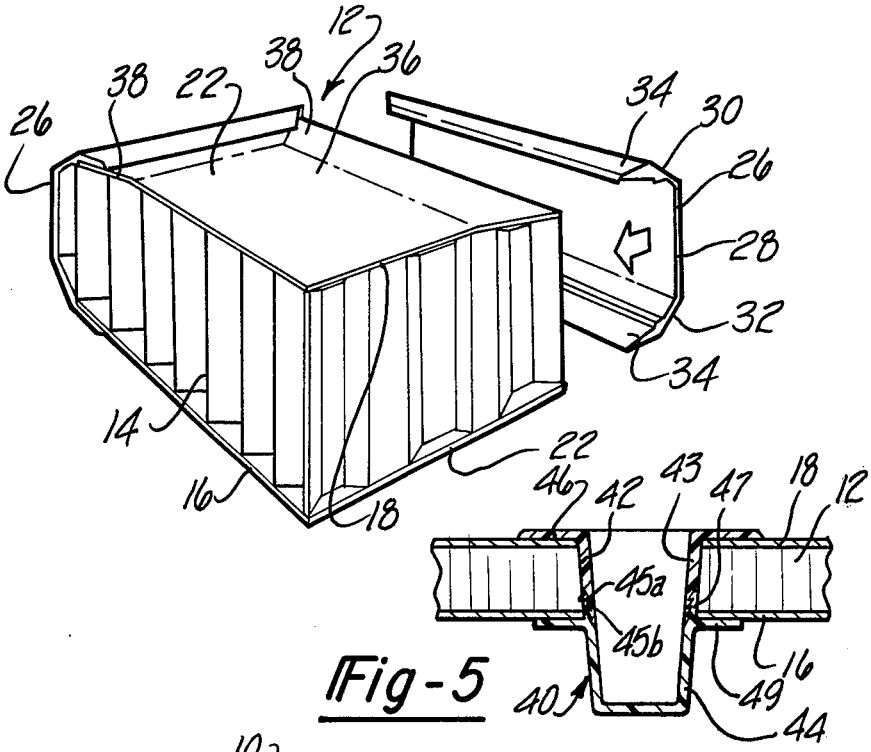
Fig-5
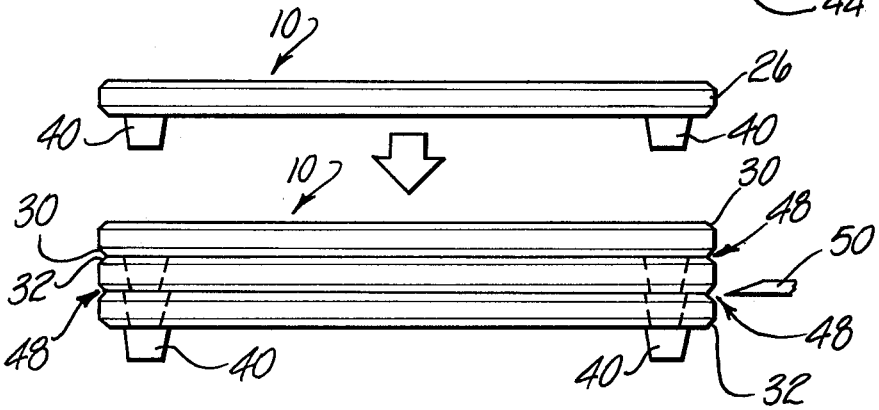
Fig-4

LIGHTWEIGHT STACKABLE PALLET

BACKGROUND OF THE INVENTION

This invention relates generally to material handling apparatus and more specifically to the use of expendable, one-way pallets for transporting various products or materials. In the past, expendable pallets have been produced using low grade materials and poor craftsmanship. Wood pallets are used frequently and are characterized by splintered wood, insects, exposed nails, and resin. These conditions can lead to damage or contamination of the product or surrounding furnishings, employee injury, and difficult handling in the absence of fork lift equipment. These conditions can also have an adverse effect on an employee's attitude toward his position. Furthermore, expendable pallets have in the past been heavy and non-uniform, and therefore incompatible with much of the conventional storing and transporting equipment presently in use.

It is an object of the present invention, therefore, to provide a lightweight, low-cost, and high-quality pallet which is compatible with present equipment and adaptable to expendable, one-way use.

SUMMARY OF THE INVENTION

The pallet of this invention includes a generally rectangular body which consists of a core structure enclosed by a top wall, a bottom wall, and four side walls. The core is formed to include a plurality of adjacent multi-sided portions which collectively constitute a honeycomb-like structure. The use of such a core structure provides high strength to weight characteristics and occasions the usage of lightweight materials in the various components of the pallet. The core itself can be formed of molded plastic or paper materials. In general, the side walls are formed of a stiff plastic such as polyvinyl chloride, and the top and bottom walls are color-coded paper products provided with plastic laminae to increase the stiffness and impact resistance of the pallet and provide waterproof protection of the core.

The side walls of the pallet are formed so as to include a vertical web portion, an upwardly and inwardly inclined portion extending between the top of the web and the top wall, and a downwardly and inwardly inclined portion which extends between the bottom of the web and the bottom wall. This particular formation allows a well-defined wedge configuration between pairs of pallets during storage when pallets are stacked one on another and facilitates removal of any desired number of pallets by a fork lift.

The pallet of this invention is also provided with a plurality of plastic legs positioned in holes preferably located in the corners of the pallet. The legs are hollow and tapered downwardly so that when pallets are stored, legs on upper pallets telescope into legs on lower pallets to facilitate stacking for storage. The legs are dimensioned so that when pallets are stacked, the bottom wall of one pallet contacts the top wall of the adjacent lower pallet so that minimum storage space is required. This arrangement prevents relative horizontal movement of pallets in storage, keeps the stack volume at a minimum, and allows the use of multi-pallet stacks in material transport where increased load support is necessary.

The invention thus provides a high-quality, high-strength pallet which can be stored or disposed of easily or used repetitively. The construction is lightweight and inexpensive and precludes encounters with sharp edges, splinters, and nails.

Further objects, features, and advantages of this invention will become apparent from the following description, the appended claims, and the accompanying drawing in which:

FIG. 1 is a perspective view of the pallet of this invention;

FIG. 2 is an exploded sectional view of a corner portion of the pallet of this invention showing the core and wall construction thereof;

FIG. 3 is an enlarged sectional view of a corner portion of the pallet of this invention;

FIG. 4 is a side view of a number of pallets in a stacked relation showing a fork lift truck tine in an initial position to lift one of the pallets in the stack; and FIG. 5 is an enlarged fragmentary sectional view of the leg portion of the pallet as seen from substantially the line 5—5 in FIG. 1.

With reference to the drawing, the pallet of this invention, seen generally at 10 in FIG. 1, is shown as having a generally rectangular body member 12. As seen in FIG. 2, the body 12 consists of a core portion 14, a bottom wall member 16, and a top wall member 18. The bottom wall 16 and the top wall 18 have external surfaces 22 which are coated with a suitable plastic to increase the strength and stiffness of the body 12. The core 14 is formed to include a plurality of adjacent multi-sided hollow columns 24, shown in FIG. 2 as hexagons.

With reference now to FIG. 3, the body 12 also includes side walls 26 which are secured to the external surfaces 22. The cross section of the side wall 26 comprises a vertical web 28, an inclined portion 30 disposed upwardly and inwardly toward the top wall 18 and integral with the top of the web 28, a second inclined portion 32 disposed downwardly and inwardly toward the bottom wall 16 and integral with the bottom of the web 28, and attaching portions 34 which secure the side wall 26 to the pallet top and bottom walls 18 and 16. FIG. 3 also shows that the top wall 18 has a substantially planar central section 36 and edge sections 38 inclined slightly downwardly. It is to these edge sections 38 that the side walls 26 are attached, and it is seen that in this attached relation, the uppermost surfaces of the side walls 26 are at the same level or substantially lower than the uppermost surface of the central section 36.

With reference to FIGS. 1 and 5, the pallet 10 is shown to include a plurality of hollow support legs 40 positioned in holes 42 preferably located in the corners of the body 12. Each leg 40 is formed in two pieces so that it has an upper section 43 and a lower downwardly tapered section 44. The leg upper section 43 is telescoped downwardly into the opening 42 to a position in which a flange 46 on the upper end of the section 43 firmly engages the top wall 18. Inclined teeth **45*a*, formed on the outer surface of the section 43 at the lower end thereof so that they extend upwardly and outwardly, interlock with similar reversely inclined teeth 45*b* on the inside surface of the lower section 44 when the flange 46 is firmly engaged with the top wall 18. An upper end portion 47 of the lower section 44, on which the teeth 45*b* are formed, is telescoped upwardly into the opening 42 and, in the interlocking positions of the teeth 45*a* and *b*, a flange 49 on the lower section 44 is firmly engaged with the bottom wall 16. The result is a light-weight body member 12 which is firmly supported between the flanges 46 and 49 on rigid load supporting legs 40**.

In FIG. 4, it is seen that the legs 40 on pairs of pallets 10 are inter-fitting. When a pair of pallets 10 are stacked one on another, the bottom wall 16 of one pallet 10 contacts the top wall 18 of an adjacent lower pallet. Increased load support is thus gained by employing multiple pallets 10 in stacked relation. It is also seen that when numbers of pallets 10 are stacked, the inclined portions 30 and 32 of the side walls 26 on adjacent pallets 10 combine to provide a wedge-shape gap 48 through which the tines of a fork lift truck, one of which is shown at 50 in FIG. 4, can penetrate and remove a desired number of pallets 10 from the stack. It is apparent that the stack is accessible to a lift truck from all four sides of the pallet 10.

It is therefore seen that the invention provides a pallet 10 which can be handled easily and stored compactly. The structure of the pallet 10, which utilizes a firm core structure 14 to provide a high strength-to-weight ratio, is such that lightweight materials can be used in the formation of pallet parts. The pallet 10 is thus inexpensive, lightweight, and easy to handle both in the presence and the absence of fork lift equipment.

What is claimed:

1. A lightweight pallet comprising a substantially horizontally disposed, generally rectangular body member having a core portion, said core being formed to include a plurality of hollow multi-sided columns collectively constituting a honeycomb-like structure, top and bottom walls secured to said core, and side walls located to cooperate with said top and bottom walls to substantially enclose said core, downwardly tapered legs on said body adjacent the corners thereof, said legs being open at their upper ends and being hollow to enable telescoping of the legs on an upper pallet into the legs on a lower pallet such that the body on said upper pallet rests on the body of said lower pallet when the upper pallet legs are telescoped into the lower pallet legs and such that a plurality of said pallets can be stacked in a minimum space, said legs terminating at their upper ends substantially at said top wall, each of said pallet side walls having inwardly inclined upper and lower edge portions so as to provide a wedge-shaped opening between stacked pallets to facilitate insertion of lifting and handling tools between adjacent stacked pallets.

* * * * *